US007036638B2

(12) United States Patent
Simmonds et al.

(10) Patent No.: US 7,036,638 B2
(45) Date of Patent: May 2, 2006

(54) BRAKE ARRESTING DEVICE WITH ADAPTABLE BRAKE FORCE FOR AN ELEVATOR

(75) Inventors: Oliver Simmonds, Luzern (CH); Stefan Hugel, Adligenswil (CH); Julien Maury, Luzern (CH); Peter Möri, Rothenburg (CH); Peter Aeschlimann, Wolhusen (CH)

(73) Assignee: Inventio AG, Hergiswil NW (CH)

( * ) Notice: Subject to any disclaimer, the term of this patent is extended or adjusted under 35 U.S.C. 154(b) by 108 days.

(21) Appl. No.: 10/324,158

(22) Filed: Dec. 19, 2002

(65) Prior Publication Data

US 2003/0085078 A1 May 8, 2003

Related U.S. Application Data

(63) Continuation of application No. PCT/CH01/00386, filed on Jun. 20, 2001.

(30) Foreign Application Priority Data

Jun. 22, 2000 (EP) ..... 00810547

(51) Int. Cl.
*B61H 7/12* (2006.01)

(52) U.S. Cl. ..... 188/44; 188/136; 188/180; 187/376

(58) Field of Classification Search ..... 188/67, 188/41–44, 136, 174–178, 189, 187, 180, 188/72.2; 187/373, 376, 372, 359, 370, 371, 187/366, 288, 351

See application file for complete search history.

(56) References Cited

U.S. PATENT DOCUMENTS

| | | | | |
|---|---|---|---|---|
| 2,555,041 | A * | 5/1951 | King | 187/372 |
| 3,762,512 | A * | 10/1973 | McIntyre | 188/189 |
| 5,323,878 | A | 6/1994 | Nakamura et al. | |
| 6,719,101 | B1 * | 4/2004 | Hugel | 187/376 |
| 2003/0085078 | A1 * | 5/2003 | Simmonds et al. | 187/373 |
| 2003/0226718 | A1 * | 12/2003 | Maury et al. | 187/373 |

FOREIGN PATENT DOCUMENTS

| | | |
|---|---|---|
| AT | 297260 | 3/1972 |
| EP | 0 825 145 | 2/1998 |
| WO | WO 01/98193 A1 * | 12/2001 |

* cited by examiner

*Primary Examiner*—Melanie Torres
(74) *Attorney, Agent, or Firm*—Butzel Long

(57) ABSTRACT

A safety brake device has a setting device moving an abutment or a housing to limit movement of brake wedges engaging a guide rail which limits a braking force applied by the brake wedges. The setting device can continuously adjust the braking force limit in dependence on a magnitude of a mass to be braked.

14 Claims, 2 Drawing Sheets

Fig. 3
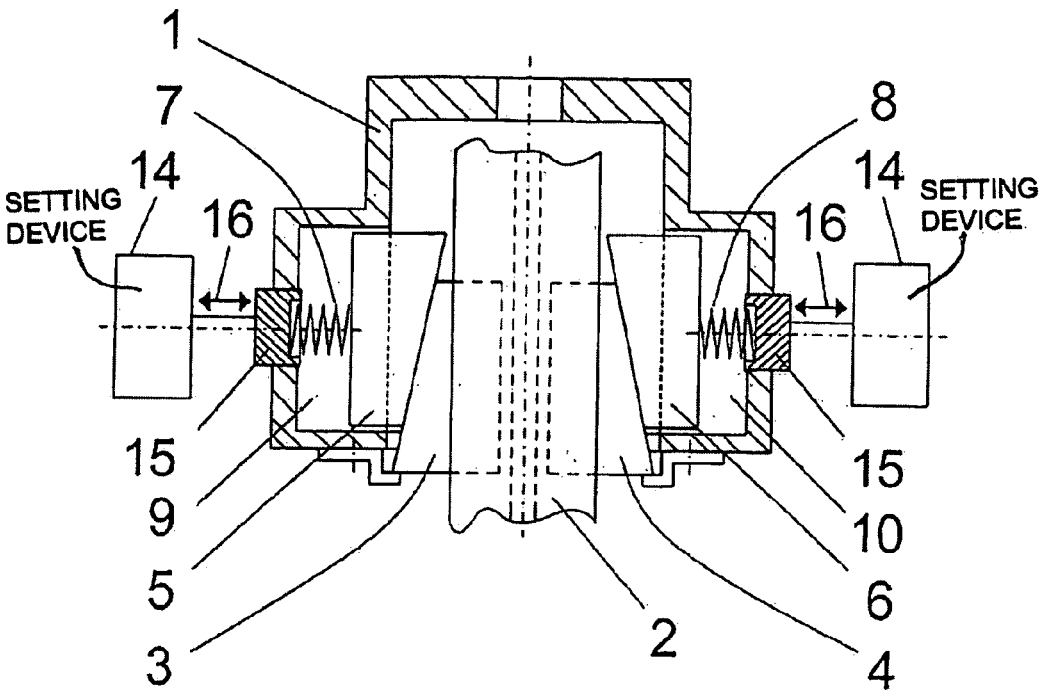
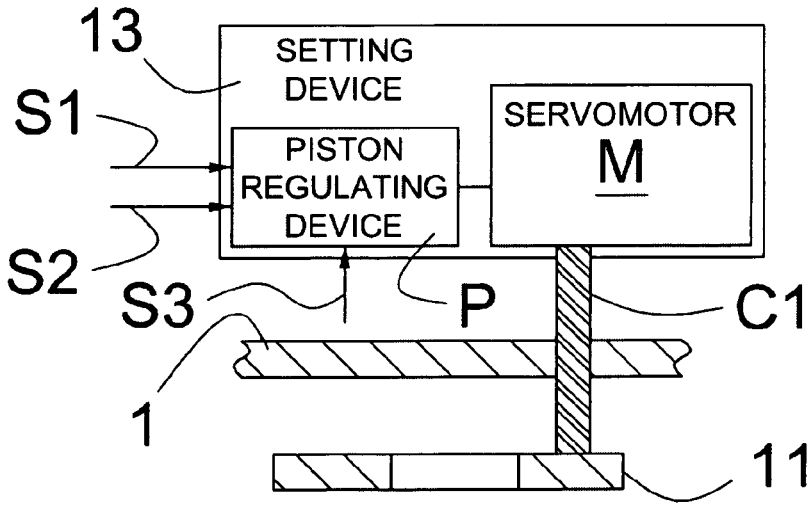
Fig. 4

BRAKE ARRESTING DEVICE WITH ADAPTABLE BRAKE FORCE FOR AN ELEVATOR

This is a continuation of application Ser. No. PCT/CH01/00386, filed Jun. 20, 2001.

BACKGROUND OF THE INVENTION

The present invention relates generally to a safety brake device for the load receiving means of vertical conveying equipment, including at least one brake wedge, which is arranged in a housing and which on triggering of a braking action acts on a guide rail of the conveying vehicle, and an abutment, which limits the stroke of the at least one brake wedge and thus limits the maximum braking force during the braking process. Moreover, the invention relates to a method of adapting the braking force of this safety brake device to the masses which are to be braked and which act on the load receiving means.

Safety brake devices as described above are used for, for example, passenger elevators, goods elevators and cages in mine conveying installations, wherein the braking process is usually triggered by a limiter cable, which acts on the brake wedge, of a speed limiter when a permissible travel speed is exceeded.

There is shown in the Austrian patent specification No 297260 a safety brake device according to the description above, in which a sliding guide, which is fastened to the elevator car and consists of angle girders, is provided for a wedge housing. The wedge housing has a recess which extends conically in a vertical direction and in which two brake wedges are arranged and surround the guide rail of the elevator with a play. The brake wedges are mounted on balls in grooves of the recess to be rollable, so that only a low rolling resistance arises at the wedge surfaces of wedge housing and brake wedges during movement thereof. The two brake wedges can be moved by a double lever seated on a shaft which is rotated by way of a lever of the limiter cable of a speed limiter. When the permissible speed of the elevator is exceeded, the brake wedges are pressed against the guide rail and initiate the braking process. A support bracket, against which the wedge housing is supported by way of plate springs, is fastened above the wedge housing to project from the car. Setting screws serving as abutments for the brake wedges and secured by nuts are arranged at the support bracket. During the braking process the brake wedges are drawn into the wedge housing to an extent corresponding with the thickness of the guide rail. The braking forces thereby arising have the effect that the wedge housing is raised against the plate springs until the brake wedges abut against the setting screws, whereby a further increase in the braking forces is prevented.

The safety brake device described in the foregoing has the disadvantage that in the case of different masses to be braked, different retardation values are generated at the load receiving means. In the case of large loads in the load receiving means a too small retardation of the load receiving means can thus arise and in the case of small loads an unacceptably high retardation of the load receiving means can arise and thus lead to harm to persons and property.

SUMMARY OF THE INVENTION

The present invention therefore has the object of proposing a safety brake device according to the first paragraph of the preceding section, but without the disadvantages of the prior art devices.

This object is met by a setting device according to the present invention which, through displacement of at least one abutment or the housing, determines the spring deflection of spring elements occurring in the case of a safety braking and thus the spring forces resulting therefrom, wherein these spring elements press the brake wedges against the guide rails of the load receiving means by the stated spring forces. The at least one abutment or the housing can thus be adjusted by means of the setting device in dependence on the magnitude of the mass, which is to be braked, of the load receiving means and the braking force between the brake wedges and the guide rail can thereby be influenced.

The advantages achieved by the device according to the present invention are that independently of the size of the actual load present in the load receiving means a defined retardation of such a magnitude that harm to persons and property is avoided can be achieved during braking.

A further advantage of the device according to the present invention is that the adjustment of the abutment or of the housing can be undertaken continuously during travel. This is important in the case of vertical conveying equipment having counter-weights and equipped with compensating cables hanging between the underside of the load receiving means and that of the counter-weight. As the proportion of the mass, which additionally influences a safety braking, of the mentioned compensating cables changes during travel it is advantageous that the position of the abutment or of the housing, on which the braking force arising in the case of a safety braking depends, can be constantly adapted to this change.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is a cross-sectional view, similar to FIG. 1, through a safety brake device according to an alternate embodiment of the present invention; and FIG. 4 is a schematic block diagram view of the setting device shown in FIG. 1.

DESCRIPTION OF THE PREFERRED EMBODIMENT

Figure 1:
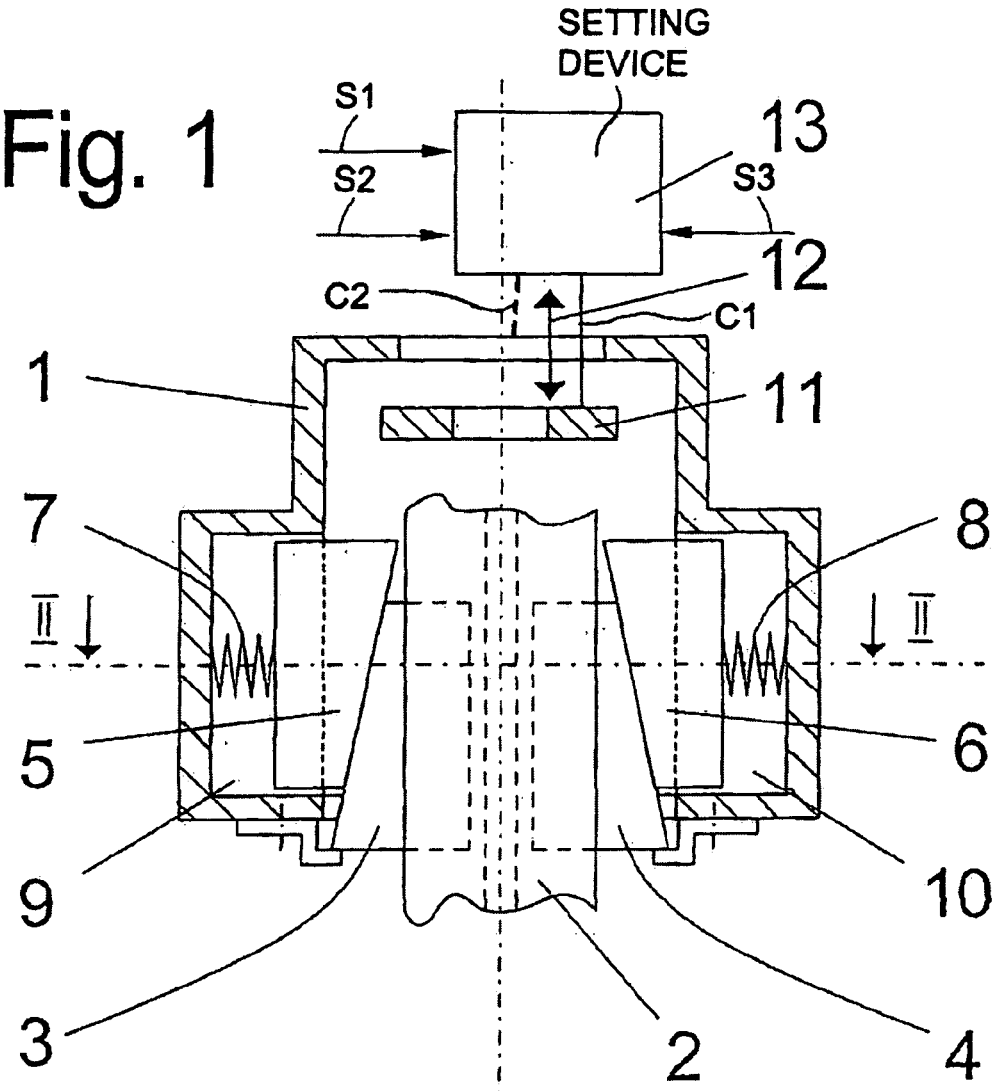
FIG. 1 is a cross-sectional view, in simplified schematic form, through a first safety brake device according to the present invention.
Figure 2:
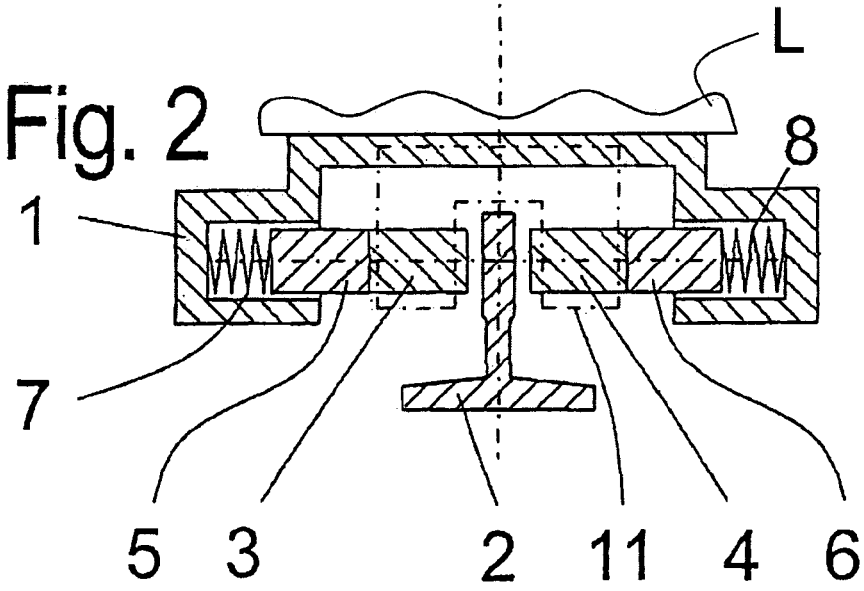
FIG. 2 is a cross section through the safety brake device according to the present invention along the line II—II in FIG. 1.

In FIGS. 1 and 2, there is shown a housing 1 fastened to a load receiving means L of vertical conveying equipment such as an elevator, and a guide rail 2 of the elevator. Brake wedges 3, 4 are arranged at both sides of the guide rail 2 in the housing 1. The brake wedges 3, 4 are supported in the housing 1 by associated counter-shoes 5, 6 and spring elements 7, 8 respectively, wherein the counter-shoes and the spring elements are guided in recesses 9, 10 respectively of the housing 1. Provided above the brake wedges 3, 4 is an abutment 11, which abutment is guided in the housing 1 and can be moved up and down in the direction of a double-headed arrow 12. For this purpose a setting device 13, which stands in operative connection with the abutment 11 and by means of which the abutment can be positioned independently of the actual masses to be braked, is provided. These masses are composed principally of the load present in the load receiving means L, the weight of the elevator car and the actually effective weight proportion of the lower cables hanging at the load receiving means. The stroke of the brake wedges 3, 4 and in dependence thereon the compression travel of the spring elements 7, 8, as well as the braking force resulting therefrom between the brake wedges 3, 4 and the guide rail 2, can be influenced by the described measures in such a manner that independently of the magnitude of the masses to be braked a retardation arises, in the case of a safety braking, by which on the one hand the load receiving means L is safely stopped and on the other hand no harm to persons or property occurs.

The setting device 13 can include, for example, an adjusting drive that contains a servomotor driving a screw spindle by means of which the abutment 11 is positioned. The servomotor and screw spindle are conventional devices represented by the block 13 and a solid line connection C1 respectively. The setting device 13 moreover includes a position regulating device which generates setting signals for the servomotor in dependence on several input signals. At least one input signal on a line S1, which reports the position of the abutment 11, as well as a signal on a line S2, which is generated by a load measuring device and represents the size of the load in the load receiving means, are evaluated. In cases where the vertical conveying equipment is equipped as described in the foregoing with compensating cables, there can be taken into consideration a further input signal on a line S3 which in dependence on the vertical position of the load receiving means represents the varying, actually effective mass of the compensating cables.

The setting device 13 of FIG. 1 is shown in more detail in FIG. 4. The lines S1, S2 and S3 are connected to inputs of the position regulating device P which has an output connected to an input of the servomotor M. The servomotor M rotates the screw spindle C1 that is connected to the abutment 11. Obviously, setting devices of another kind can also be used for the abutment positioning, such as, for example, known hydraulically actuated servo setting cylinders or known motor-driven cam discs as represented by the block 13 and the line C1 in FIG. 1.

As known per se, when a permissible speed is exceeded by the elevator car, the brake wedges 3, 4 are raised by way of a limiter cable of a speed limiter and a lever arrangement (not shown). Due to the wedge effect between the brake wedges 3, 4 and the counter-shoes 5, 6 the former are moved towards the guide rail 2 until they contact it. Due to the occurrence of friction forces between the brake wedges 3, 4 and the guide rail 2 the brake wedges 3, 4 are drawn upwardly as far as the abutment 11, which causes a lateral displacement of the counter-shoes 5, 6 by the wedge effect and the spring deflection of the spring elements 7, 8. The compressed spring elements 7, 8 now press the brake wedges 3, 4 against the guide rail 2, whereby a braking force which is dependent on the position of the abutment 11 and counteracts movement of the load receiving means arises between the brake wedges and the guide rail.

By contrast to the equipment described in the foregoing in which the housing 1 is fixed to the load receiving means and the abutment 11 is displaced by the setting device 13, in a variant embodiment the abutment 11 can be fixed to the load receiving means and the housing together with the brake wedges 3, 4, the counter-shoes 5, 6 and the spring elements 7, 8 can be displaced. This arrangement is illustrated in FIG. 1 by a dashed line connection C2 between the setting device 13 and the housing 1 that replaces the solid line connection C1. In that case the triggering and the braking effect of the safety braking device remain practically unchanged.

An alternate embodiment according to FIG. 3 has, instead of the abutment 11 determining the end setting of the brake wedge, two abutments 15 guided in the region of the recesses 9, 10 in the wall of the housing 1. These abutments form adjustable supports for the spring elements 7, 9 movable in the direction of a double-headed arrow 16, with the assistance of which the spring deflection of the spring elements 7, 8 arising, in the case of a safety braking, by the wedge effect of the brake wedges 3, 4 can be varied. Two setting devices 14 position associated ones of the abutments 15 before each travel and optionally also during travel, so that in the case of a safety braking the spring deflection of the spring elements 7, 8 and thus the spring forces resulting therefrom, by which the spring elements 7, 8 press the brake wedges 3, 4 against the guide rail 2, are matched to the actual mass to be braked. The functional characteristics of the setting devices 14 correspond with those of the setting device 13 described in the foregoing.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety brake device for a load receiving means of vertical conveying equipment, comprising:

a housing adapted to be attached to the load receiving means;

at least one brake wedge arranged in said housing and being responsive to a triggering of a braking action to move in a direction for engaging a guide rail of the conveying equipment with a wedge effect for braking the load receiving means;

a spring element mounted in said housing and applying a spring force to said at least one brake wedge;

an abutment positioned to limit movement of said at least one brake wedge in said direction thereby limiting a braking force applied by said spring element through said at least one brake wedge; and a setting device connected to one of said abutment and said housing for selectively automatically positioning said one of said abutment and said housing in response to changes in an input signal representing an actual mass of the load receiving means to be braked, whereby when said housing is attached to the load receiving means and moved along the guide rail and a braking action is triggered to brake the load receiving means from a travel condition to a stopped condition, said at least one brake wedge responds to the triggering by moving in the direction into contact with the guide rail and applying a braking force to the guide rail limited by the position of said one of said abutment and said housing selected by said setting device in response to the last of said changes in said input signal.

2. The safety brake device according to claim 1 including a counter-shoe mounted in said housing between said at least one brake wedge and said spring element, said counter-shoe slidably engaging said at least one brake wedge.

3. The safety brake device according to claim 1 wherein said setting device repositions said one of said abutment and said housing prior to each movement of the load receiving means along the guide rail.

4. The safety brake device according to claim 1 wherein said setting device continuously repositions said one of said abutment and said housing during travel of the load receiving means.

5. The safety brake device according to claim 1 wherein the direction is parallel to a direction of travel of the load receiving means along the guide rail.

6. The safety brake device according to claim 1 wherein the direction is transverse to a direction of travel of the load receiving means along the guide rail.

7. The safety brake device according to claim 1 wherein said spring element acts at one end on said at least one brake wedge and at an opposite end on said abutment.

8. The safety brake device according to claim 1 wherein said setting device includes an adjusting drive having a servomotor driving a screw spindle connected to said abutment.

9. The safety brake device according to claim 1 wherein said setting device is responsive to a first input signal representing an actual load applied by the load receiving means and a second input signal reporting a position of said abutment.

10. A method of matching a braking force of a safety brake device for a load receiving means of vertical conveying equipment to masses that are to be braked and which masses act on the load receiving means during a safety braking, comprising:

a. providing a housing having arranged therein at least one brake wedge that moves in response to a triggering of a braking process to act on a guide rail along which the load receiving means moves and attaching the housing to the load receiving means;

b. providing an abutment for engagement by the at least one brake wedge to limit a braking force applied to the guide rail by the at least one brake wedge;

c. providing a setting device connected to one of the housing and the abutment;

d. generating a signal representing an actual mass of the load receiving means during operation of the load receiving means;

e. operating the setting device to move the one of the housing and the abutment to a selected position in response to the signal whereby a braking force applied by the at least one brake wedge is automatically limited in response to an actual mass of the load receiving means.

11. The method according to claim 10 including a step of inputting to said setting device a signal representing a loading of the load receiving means and determining the selected position based upon the loading.

12. The method according to claim 11 including a step of generating the signal as a representation of a mass of compensating cables attached to the load receiving means.

13. The method according to claim 10 including performing said step d, during travel of the load receiving means.

14. A safety brake device for a load receiving means of vertical conveying equipment, comprising:

a housing;

a pair of brake wedges arranged in said housing and being responsive to a triggering of a braking action to move into engagement with a guide rail and apply a braking force;

a pair of counter-shoes mounted in said housing, each said counter-shoe abutting an associated one of said brake wedges;

a pair of spring elements mounted in said housing, each said spring element engaging an associated one of said counter-shoes and applying a spring force to said associated brake wedge;

at least one abutment positioned to limit movement of said brake wedges in engagement with the guide rail thereby limiting the braking force applied by said brake wedges to the guide rail; and at least one setting device connected to one of said at least one abutment and said housing for selectively automatically positioning said one of said at least one abutment and said housing in response to an input signal representing an actual mass of the load receiving means to be braked, whereby when said housing is attached to the load receiving means and moved along the guide rail and a braking action is triggered to brake the load receiving means, said brake wedges respond to the triggering by moving into contact with the guide rail and applying the braking force to the guide rail limited by a selected position of said one of said at least one abutment and said housing selected by said at least one setting device at at least one of at the start of travel and during travel of the load receiving means.

* * * * *